United States Patent [19]

Webb et al.

[11] 4,114,698

[45] Sep. 19, 1978

[54] METHOD AND APPARATUS FOR TUNNELING UPWARDLY

[75] Inventors: Daniel R. Webb, Santa Ana; John R. Steinke, Fountain Valley; Robert W. Berry, Brea; Stanard R. Funsten, San Marino, all of Calif.

[73] Assignee: Smith International, Inc., Newport Beach, Calif.

[21] Appl. No.: 551,083

[22] Filed: Feb. 20, 1975

[51] Int. Cl.[2] ..... E21B 7/00

[52] U.S. Cl. ..... 173/1; 173/152; 173/164; 175/52; 175/85

[58] Field of Search ..... 175/102, 101, 122, 57, 175/94, 52, 320, 321, 171, 92, 85; 173/164, 152, 1; 299/31

[56] References Cited

U.S. PATENT DOCUMENTS

| | | | |
|---|---|---|---|
| 1,264,156 | 4/1918 | Chapman | 173/164 |
| 3,460,638 | 8/1969 | Millsapps, Jr. | 175/85 |
| 3,554,298 | 1/1971 | Klein | 175/85 |
| 3,604,754 | 9/1971 | Hosel | 299/31 |
| 3,741,322 | 6/1973 | Wolters | 175/52 |
| 3,750,769 | 8/1973 | Young et al. | 175/85 |
| 3,833,070 | 9/1974 | Anderson | 173/164 |
| 3,851,714 | 12/1974 | Visser | 173/164 |
| 3,857,451 | 12/1974 | Williams | 173/152 |

*Primary Examiner*—Ernest R. Purser
*Assistant Examiner*—William F. Pate, III
*Attorney, Agent, or Firm*—Gene W. Arant

[57] ABSTRACT

A vertical thrust boring machine adapted to be positioned in the horizontal drift of a mine and to cut a tunnel extending upwardly from the drift so as to remove ore or other cuttings therefrom. The machine includes a rotary table for lifting a drill string which in turn supports the cutter head, and is characterized by drill stem sections having a spline connection on their lower ends, and a drive coupling ring associated with the rotary platform having a mating spline connection, so that when changing the length of the drill string the lowermost drill stem section can slide or float vertically relative to the rotary platform at the same time that it is being drivingly rotated.

6 Claims, 21 Drawing Figures

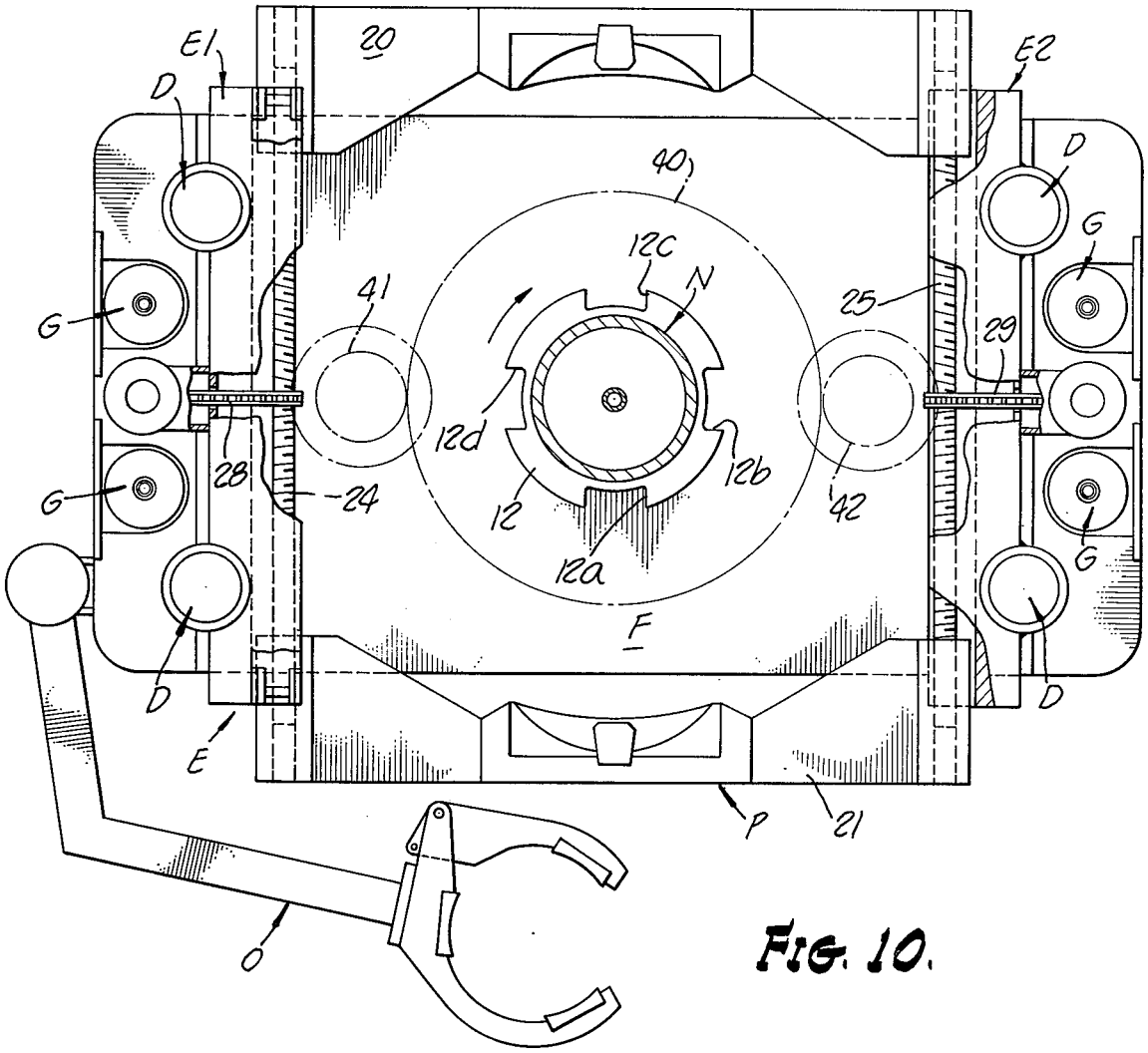
FIG. 10.
FIG. 11.
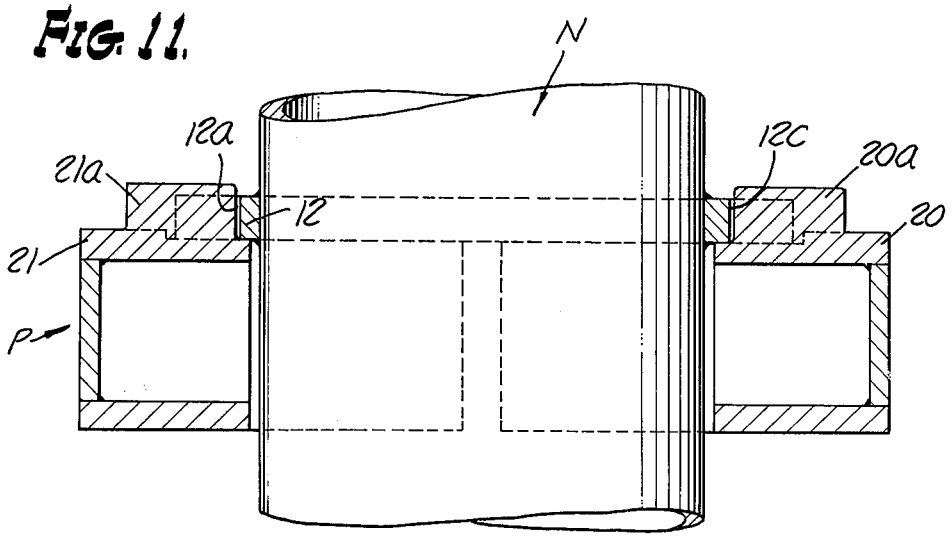

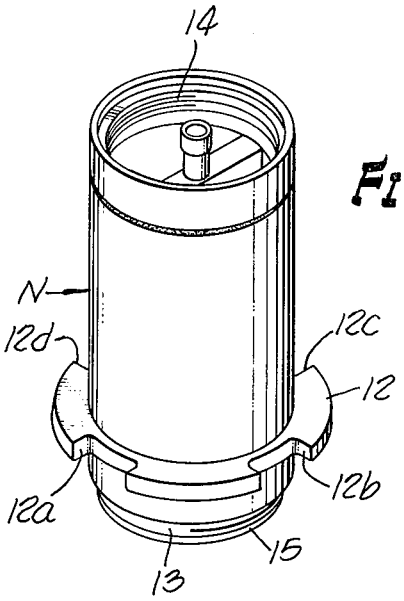
FIG. 13.
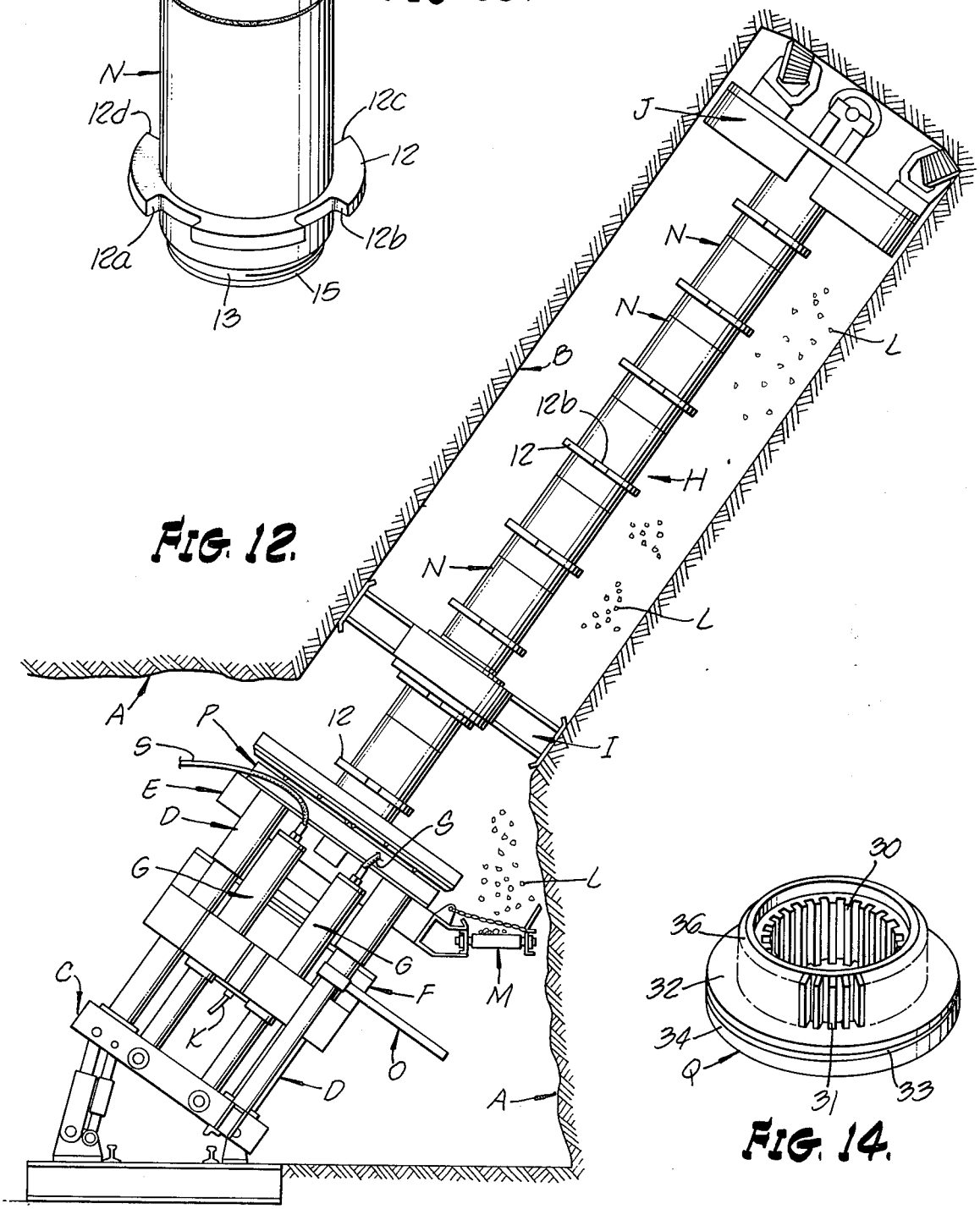
FIG. 12.
FIG. 14.

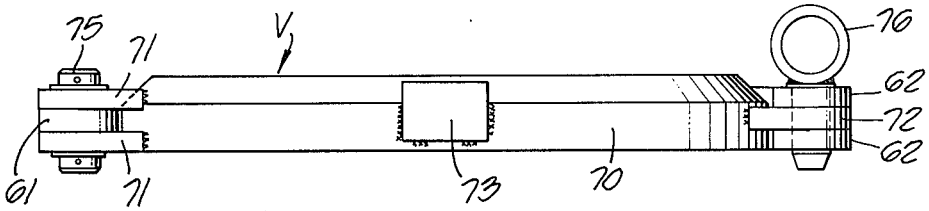
FIG. 15.
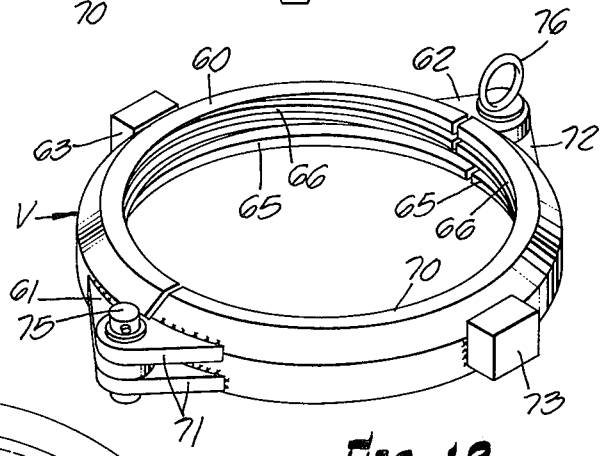
FIG. 18.
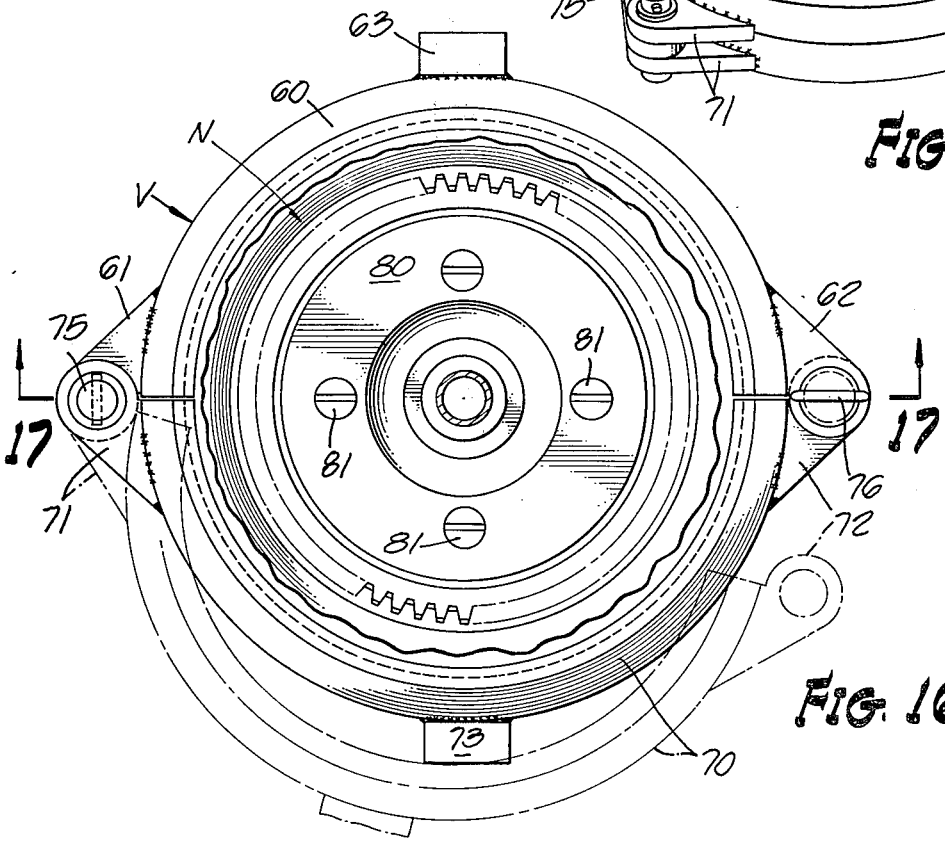
FIG. 16.
FIG. 17.
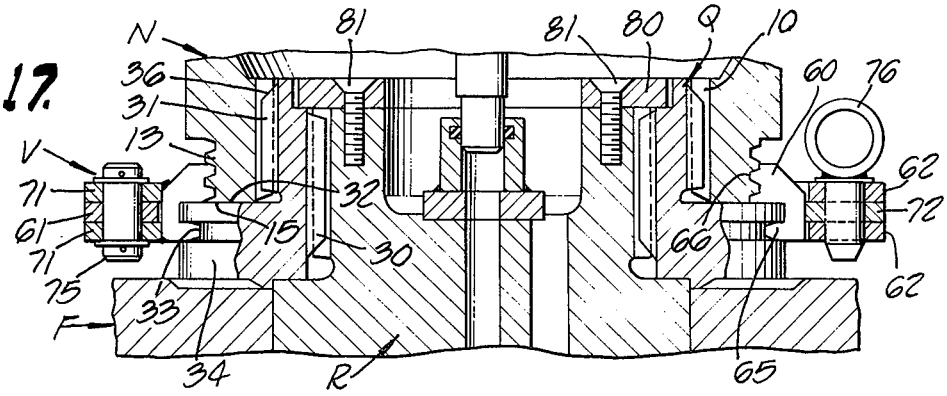

METHOD AND APPARATUS FOR TUNNELING UPWARDLY

BACKGROUND OF THE INVENTION

Machines for tunneling upwardly in a mine are well-known in the art, and are sometimes referred to as raise boring machines, or box hole machines, but in the present description this type of machine is referred to as a vertical thrust boring machine.

Among the many prior art U.S. patents are the Busby U.S. Pat. No. 3,830,318 and the Crane et al. U.S. Pat. No. 3,840,272.

It has been customary in machines of this type to utilize a holding means, sometimes referred to as a hairpin assembly, which grasps the drill string above the elevation of the lowermost drill stem section so as to establish the vertical position of the drill string while the lowermost section is being attached or detached. When the tunnel is being extended upwardly the drill stem sections are successively attached to the lower end of the drill string so as to extend the length of the string. When the cutter head is being retrieved the drill stem sections are successively detached, one at a time, from the lower end of the string.

Many and perhaps most of the vertical thrust boring machines have made up the drill string by using drill stem sections having threaded ends, there being a male thread on one end and a female thread on the other end. The attachment or detachment of a drill stem section, therefore, requires a rotating drive for the purpose of either making or breaking a threaded connection.

Experience has shown that when operating this type of machine in a mine, the "down time" is a significant problem. That is, a substantial portion of the working time of both the machine and its operator is used up in attaching or detaching the pipe sections. This operation is a rather delicate and difficult one, because while the threads on the pipe have a definite pitch which establishes a predetermined ratio between rotary movement and vertical movement, the machines have customarily been provided with a vertical drive for the rotary platform which is separate and apart from the rotary drive for the rotary platform. Furthermore, there does not appear to be any convenient means of synchronizing the vertical drive with the rotary drive, that would be reliable under the operating conditions to which the machine is subjected.

Therefore, the "down time" involved in attaching or detaching pipe sections to the drill stem has been accepted as a necessary evil or limitation of this type of machine.

SUMMARY OF THE INVENTION

According to the present invention the precise synchronization of the vertical and rotary drives for the rotary table is made unnecessary. Furthermore, the time heretofore required for attaching the lowermost drill stem section to the rotary table, or detaching it from the rotary table, is very greatly reduced.

According to the present invention each drill stem section is made with a male thread on one end and a female thread on the other end, as has been the practice in the past. In addition, however, a spline connection is also formed on that particular end of the drill stem section which will be oriented in a downwardly direction. The rotary platform is equipped with a drive coupling ring having a spline connection that is adapted to matingly engage the spline connection on the lower end of the drill stem section. The drive coupling ring is secured to the rotary table to move with it, including both rotary and vertical movements. When attaching the drill stem section to the rotary table the thread on the lower end of the drill stem section is not used, and only the spline connection is used for the purpose of this attachment. The thread on the lower end of each drill stem section is used, however, as the drill string is extended and another drill stem section is threadedly secured to the lower end of what had previously been the lowermost drill stem section.

According to the present invention the threaded engagement or disengagement of the lowermost drill stem section with the lower end of the previously formed drill string is guided entirely and exclusively by the pitch of the thread, and a vertical sliding or floating action of the drill stem section takes place with reference to the rotary table or platform. This floating movement is made possible by the splined coupling between the spline connection of the drive coupling ring and the spline connection on the lower end of the lowermost drill stem section.

The present application also discloses a second and separate invention, namely, an improved holding means or hairpin assembly. The hairpin assembly is characterized by a pair of jaws, a parallel pair of turnbuckle shafts which extend perpendicular to the jaws in a generally rectangular configuration, with each end of each shaft being received by a threaded opening in an associated end of one of the jaws, and also including power driven means for rotating the two shafts concurrently so as to open or close the jaws in unison.

DRAWING SUMMARY

FIG. 10 is a plan view, partially in cross-section, taken on the line 10—10 of FIG. 6;

FIG. 11 is a fragmentary cross-sectional view taken on the line 11—11 of FIG. 3;

FIG. 12 is an elevational view of the machine with the drill string thereof extended a considerable length so as to drill a tunnel upwardly but at some angle from the precisely vertical direction;

FIG. 13 is a perspective view of a single drill stem section;

FIG. 14 is a perspective view of the drive coupling ring that is utilized in conjunction with the rotary drive table or platform;

FIG. 15 is a side elevational view of a clamp assembly that is used in conjunction with the drive coupling ring of FIG. 14;

FIG. 16 is a top plan view, partially in cross-section, showing the drive coupling ring with its associated clamp assembly, and the open position of the clamp assembly being indicated by dotted lines;

FIG. 17 is taken on the line 17—17 of FIG. 16, and is a fragmentary cross-sectional elevational view of the rotary table, spindle, drive coupling ring, lowermost drill stem section, and clamp assembly;

FIG. 18 is a perspective view of the clamp assembly of FIG. 15;

Figure 1:
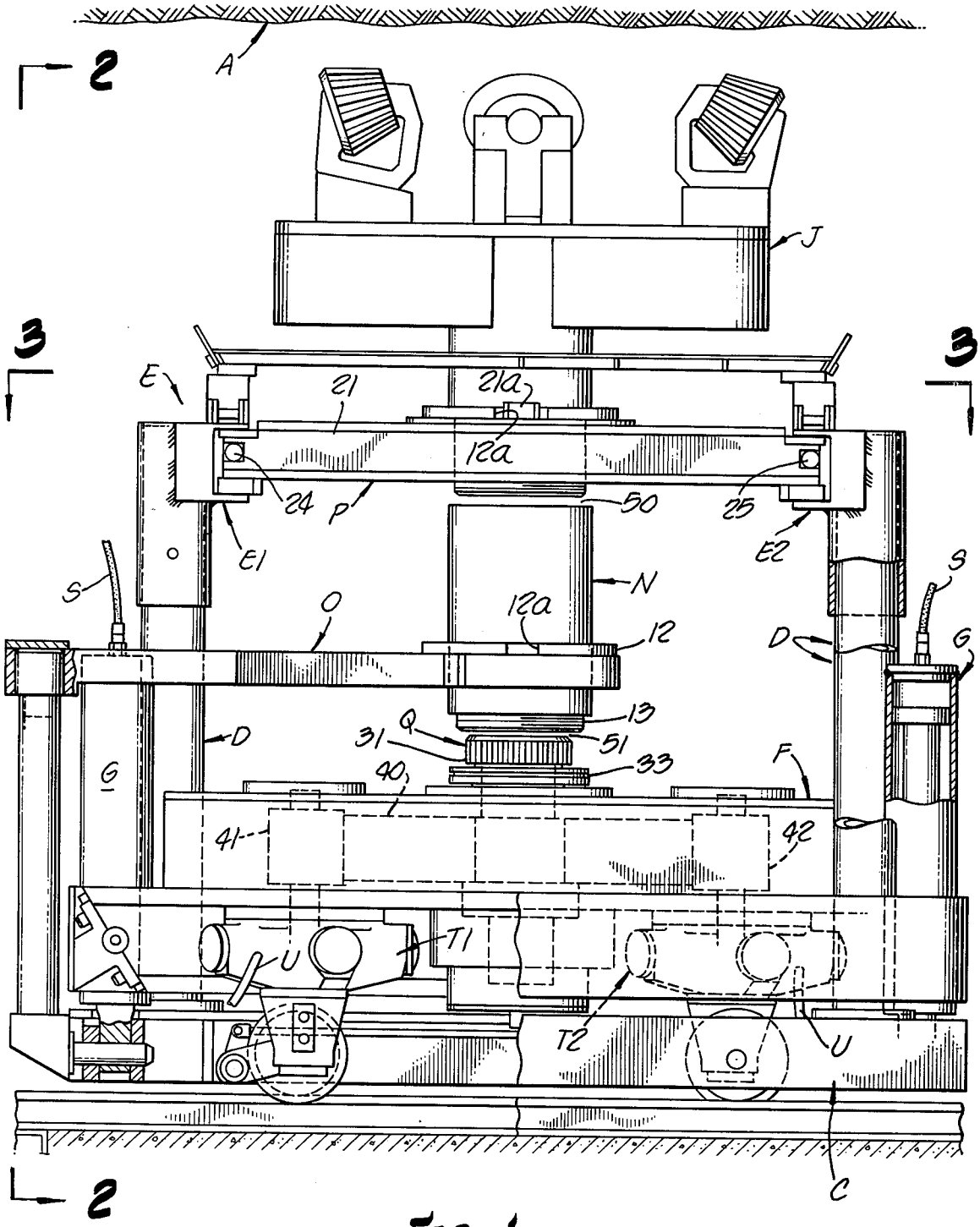
FIG. 1 is a front elevational view of a vertical thrust boring machine in accordance with the presently preferred form of the invention.

| PARTS LIST | |
|---|---|
| A | Drift |
| B | Hole or Tunnel |
| C | Lower Bed |
| D | Corner Posts (4) |
| E | Upper Bed (E1, E2, Frame Portions) |
| F | Rotary Table |
| G | Rams (4) to Raise Table |
| H | Drill String |
| I | Stabilizer |
| J | Cutterhead |
| K | Water Line |
| L | Cuttings |
| M | Conveyor |
| N | Drill Stem Section |
| O | Positioner |
| P | Hair Pin Assembly |
| Q | Drive Coupling Ring |
| R | Spindle |
| S | Lift Control (for Rams) |
| T | Rotary Drive Motors (T1, T2) |
| U | Rotary Control (for Motors) |
| V | Clamp Assembly |
| N′ | First Alternate Drill Stem Section |
| N″ | Second Alternate Drill Stem Section |
| N‴ | Third Alternate Drill Stem Section |
| 10 | Spline Connection of N |
| 12 | Collar of N |
| 12a,b,c,d | Recesses in 12 |
| 13 | Male Thread of N |
| 14 | Female Thread of N |
| 15 | Lower End Face of N |
| 20,21 | Jaws |
| 20a,21a | Lugs on Jaws |
| 24,25 | Turnbuckle shafts |
| 28,29 | Drive Chains |
| 30 | Internal Spline of Q |
| 31 | External Spline of Q |
| 32 | Shoulder of Q |
| 33 | Groove in 34 |
| 34 | Base of Q |
| 36 | Chamfer of 31 |
| 40 | Bull Ring |
| 41,42 | Pinion Gears |
| 50 | Clearance Space |
| 51 | Clearance Space |
| 52 | Clearance Space |
| 60 | Clamp Portion |
| 61 | Hinge of 60 |
| 62 | Hinges of 60 |
| 63 | Block on 60 |
| 65 | Circular Flange on 60, 70 |
| 66 | Female Thread of 60, 70 |
| 70 | Clamp Portion |
| 71 | Hinges of 70 |
| 72 | Hinge of 70 |
| 73 | Block on 70 |
| 75 | Hinge Pin |

-continued

| PARTS LIST | |
|---|---|
| 76 | Fastening Pin |
| 80 | Keeper Ring |
| 81 | Screws |
| 91 | Shoulder of N′ |
| 92 | Shoulder of N‴ |

GENERAL DESCRIPTION

The vertical thrust boring machine of the present invention has many similarities to previously known machines of this type. It is therefore advantageous to first describe in a general way the overall machine and its method of operation, with only a very brief mention of the novel features of the machine that are provided in accordance with the present invention. Thereafter the novel structural features that are provided in accordance with the invention, and the novel method of operation which is achieved in accordance with the invention, will be described in some detail in separate chapters of this description.

FIG. 12 shows a horizontal tunnel or drift A in a mine, through whose upper wall or ceiling an upward hole or tunnel B has been cut. Some of the major parts of the vertical boring machine as shown in FIG. 12 are a lower bed C, a set of four corner posts D which extend upward from the lower bed C, and an upper bed E supported on the posts D. Upper bed E supports, and to a large extent contains, the holding means or hairpin assembly P which will later be described.

A rotary table F is positioned intermediate to the lower bed C and the upper bed E. A set of four vertically extending rams G have their lower ends secured to the lower bed C and are operable for selectively raising or lowering the rotary table F above the lower bed C.

A drill string H extends a considerable distance above the rotary table or platform F, and through the upper bed E and hence on up into the hole or tunnel B so as to support a cutter head J at the upper end of the hole. A stabilizer I is attached to the drill string H at one point along its length in order to provide lateral stabilization of the drill string in the hole.

Figure 6:
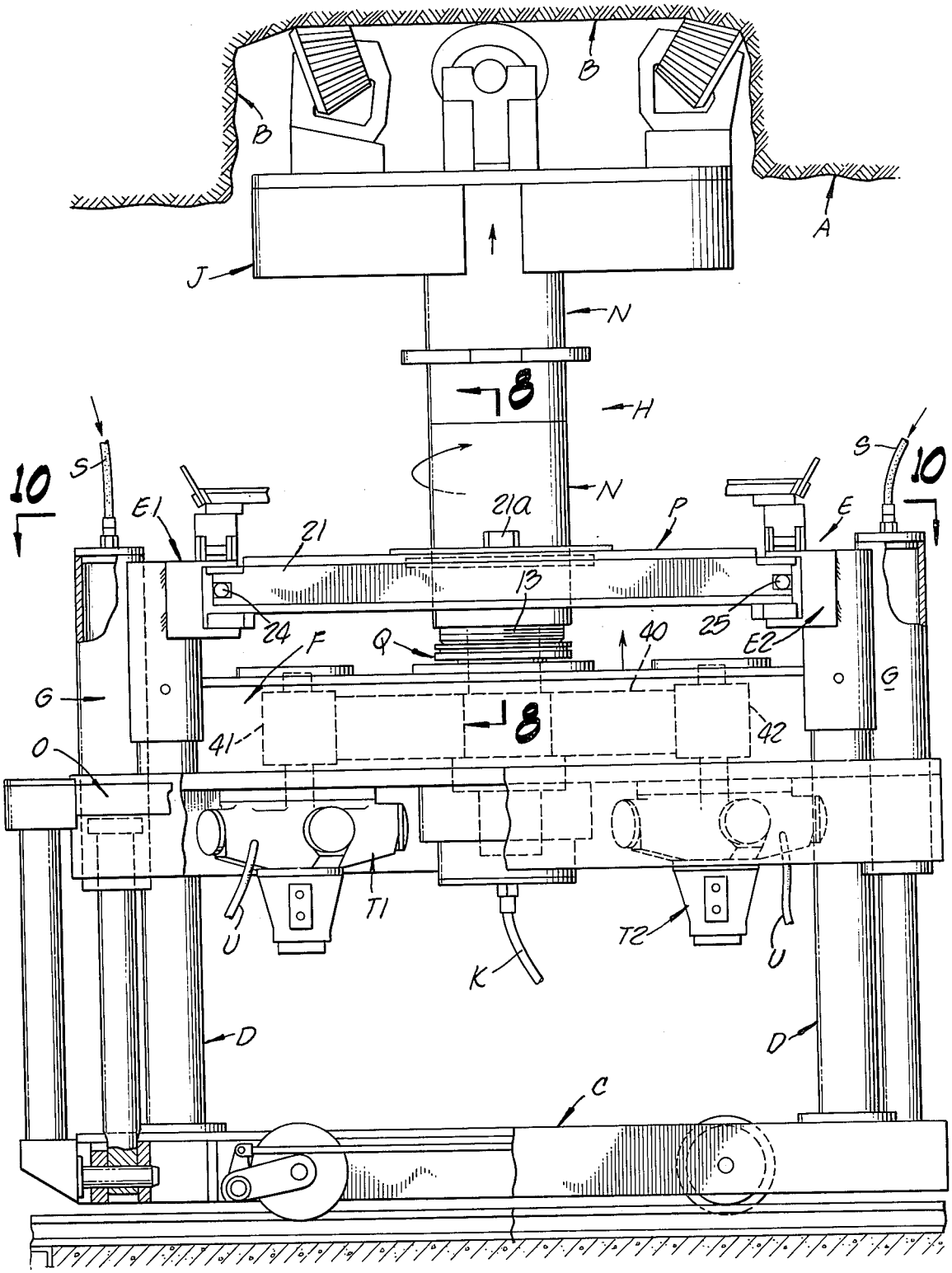
FIG. 6 is a front elevational view of the machine in actual operation, cutting a tunnel in the upwardly direction.

Referring specifically to FIG. 6, a water line K is utilized to supply water under pressure through the interior of the drill string H and hence to the cutter head J so as to assist in loosening the cuttings L (FIG. 12) and facilitate their removal in a downward direction from the hole B where they are gathered by the conveyor M which is positioned auxiliary to the upper bed E of the machine.

Figure 9:
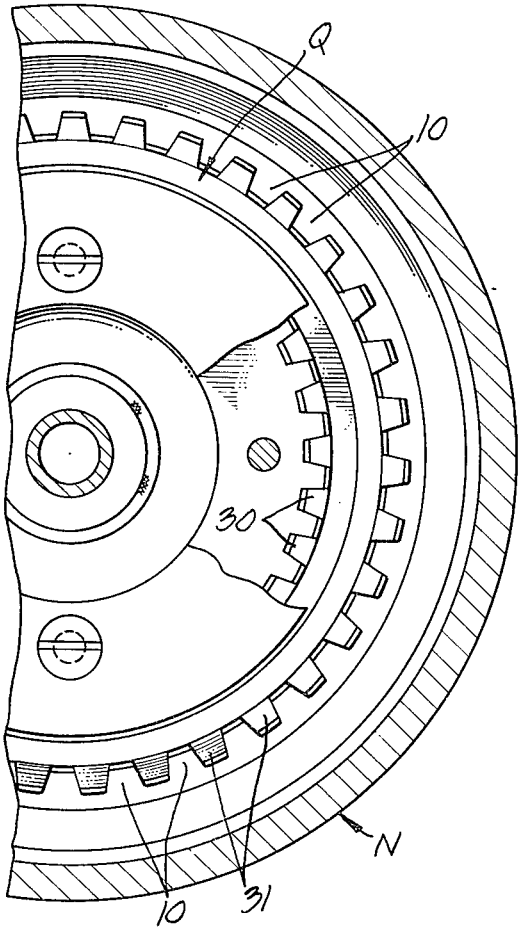
FIG. 9 is a horizontal cross-sectional view taken on the line 9—9 of FIG. 8.
Figure 8:
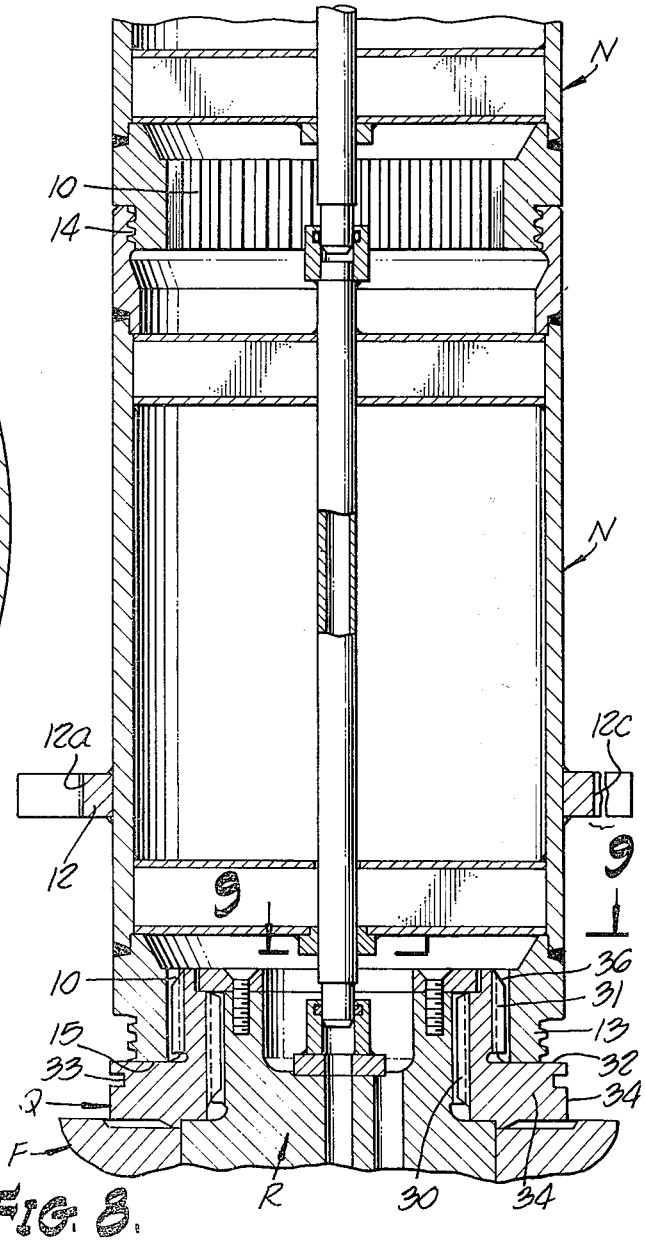
FIG. 8 is a cross-sectional elevational view taken on the line 8—8 of FIG. 6.

The machine as thus far described is old in the art. Reference is now made to FIG. 13 showing a perspective view of a drill stem section N in accordance with the invention. The novel feature of drill stem section N is a spline connection 10 which cannot be seen in FIG. 13 but which is clearly shown in FIGS. 8 and 9.

The machine also includes a positioner O for holding a drill stem N in place while it is being attached to or detached from the drill string H, and the positioner O is perhaps best illustrated in FIGS. 1, 3, 4, and 10. While some of the features of structure and operation of the positioner O are novel, devices of this general type have been previously known, and have previously been incorporated in vertical thrust boring machines.

Figure 3:
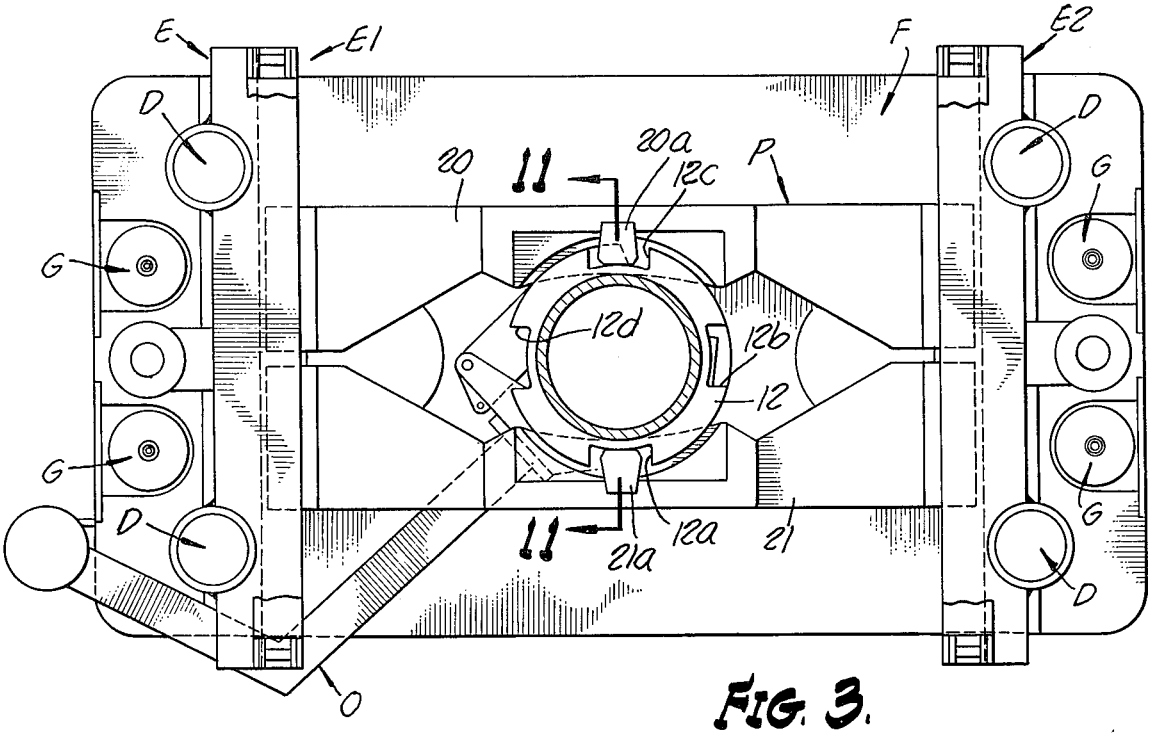
FIG. 3 is a plan view taken on the line 3—3 of FIG. 1.

The hairpin assembly (or holding means) P is best shown in FIGS. 3 and 10. The upper bed E includes a pair of parallel frame portions E1, E2. Parallel track means are formed in the frame portions E1, E2. A pair of jaws 20, 21 are supported in the track means, and move in either an opening or a closing action in the horizontal plane. Associated with the respective track means are turnbuckle shafts 24, 25, and which together with the jaws 20, 21 form an assembly having a generally rectangular configuration. Each threaded end of each turnbuckle shaft is received in a corresponding threaded opening of the associated jaw end. Turnbuckle shafts 24, 25 are provided with pinion gears on their longitudinal centers, each gear being driven by a corresponding one of the drive chains 28, 29. The drive chains are powered in synchronism so as to rotate the turnbuckle shafts in unison and thereby selectively open or close the jaws 20, 21.

The drive coupling ring Q shown in perspective in FIG. 14 is a novel structural portion of the machine in accordance with the present invention. The coupling ring Q also appears in FIGS. 1, 2, 4, 5, 6, 8, and 9. The ring Q is also shown in FIGS. 16 and 17. Ring Q has an internal spline connection 30 which is engaged by and driven by the spindle R. Ring Q also has an external spline connection 31 the upper end of which is chamfered at 36, and which engages the spline connection 10 of drill stem section N. Ring Q also has a lower end or base portion which is of larger diameter than its upper end, the upper end of the base forming an upwardly facing circumferential flat shoulder 32. Around the entire circumference of the base 34 is an exterior groove 33. The purpose of groove 33 is to hold the clamp assembly V.

Spindle R is rotatably supported in the rotary table F (FIGS. 8 and 17) and is driven through a gear drive mechanism 40, 41, 42 by rotary drive motors T1, T2. Bull ring 40 is rigidly attached to the lower end of spindle R. Pinion gear 41 driven by rotary drive motor T1 engages the bull ring 40 on one side while pinion gear 42 driven by rotary drive motor T2 engages the bull ring on the opposite side. The rotary drive motors T1, T2 are of the hydraulic type and it is possible to energize either or both of these motors.

The clamp assembly V is a novel structural portion of the machine, and is selectively utilized when and as needed in conjunction with the drive coupling ring Q.

Figure 2:
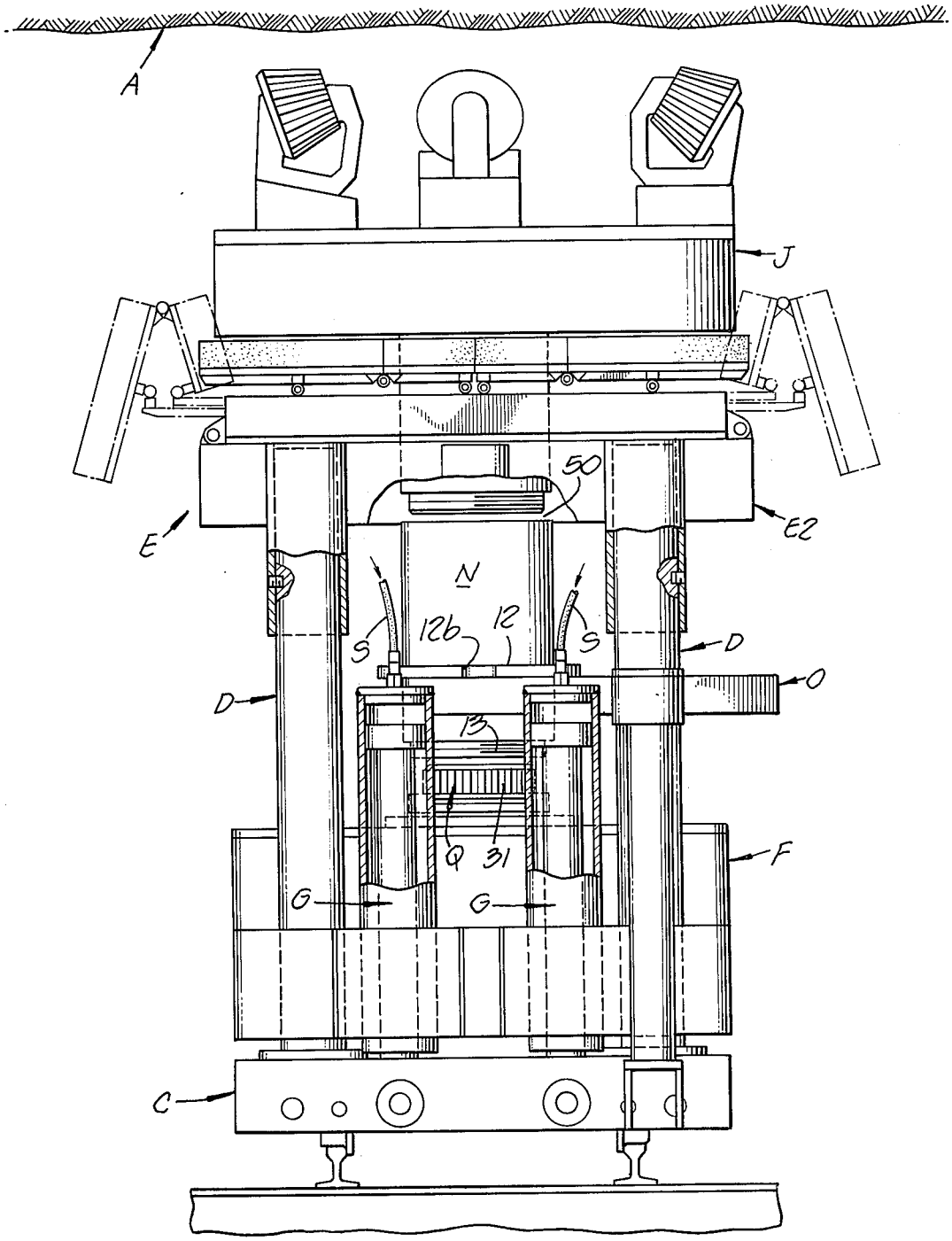
FIG. 2 is a side elevational view taken on the line 2—2 of FIG. 1.

The control of the rams G, for raising or lowering the rotary table F, is provided through hydraulic lines S (FIGS. 1 and 2). The control of rotary drive motors T1, T2 is provided through hydraulic lines U (FIG. 6).

METHOD OF EXTENDING DRILL STRING

When the drill string H is to be raised or extended, it is first grasped by the hairpin or holding means P at a location above the top of the lowermost drill stem section N, in order to fix the vertical position of the previously existing drill string. Since the hairpin assembly P has a fixed location in the upper bed E, it is necessary to lower the rotary table F so as to provide space for a drill stem section N. This position of the machine is shown in FIG. 1. It will be noted that positioner O grasps the drill stem section in such manner that there is a clearance space 50 between the upper end of drill stem section N and the lower end of the pre-existing drill string, and there is also a clearance space 51 beneath the lower end of drill stem section N and the drive coupling ring Q. As typical values, the drill stem section N is about 3½ feet in length, while each of the clearance spaces is about one inch.

The precise manner of operation of the hairpin assembly P, in providing both vertical and rotational support of the drill string H, is described in detail in a later chapter of this description.

Figure 4:
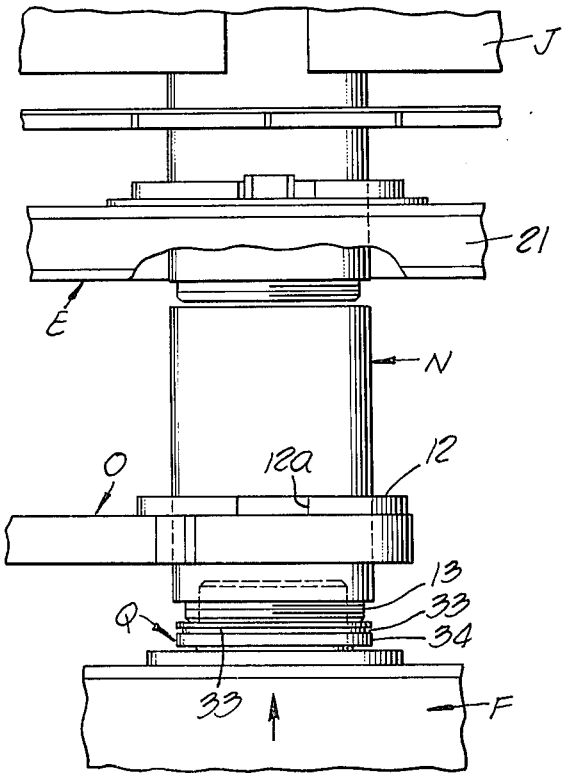
FIG. 4 is a fragmentary elevational view of the machine showing a drill stem section that is about to be attached to the drill string.

The next step is shown in FIG. 4, where the rotary table F has been raised a short distance in order to permit the spline connection 31 of the drive coupling ring Q to become interengaged with the spline connection 10 in the lower end of drive stem section N. The chamfered upper surfaces 36 of spline 31 assist in this engagement. Also, positioner O is constructed in such manner as to permit some rotation of the drill stem section N, and because of the number of teeth and grooves (or keys and key ways) in each spline connection the amount of this rotary movement need never be more than about 4°. When the interengagement occurs the operator continues to raise the rotary table F by a small distance, by applying pressure through hydraulic control lines S to the lifting rams G, until the drill stem section N is firmly seated on the drive coupling ring Q.

Drill stem section N has a collar 12 which rests upon the encircling portion of the positioner O. In raising the rotary table F, therefore, no harm is done if the operator overshoots the mark by a small distance. The reason for providing the clearance space 50 in the first instance is to avoid damage to the threads of both the drill string and the new drill stem section as a result of hard-driven vertical contact.

When drill stem section N is fully supported from drive coupling ring Q as shown in FIG. 4, it also has a firm vertical support from the spindle R and therefore from the rotary table F. The support of positioner O is no longer needed, so the positioner is swung out of the way.

Figure 7:
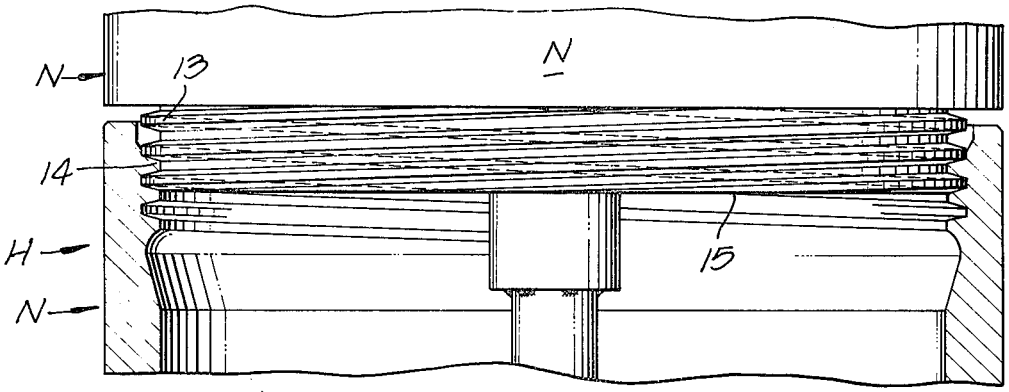
FIG. 7 is an enlarged fragmentary cross-sectional view taken on the line 7—7 of FIG. 5.

The next step of the process is not specifically shown in the drawings because of inherent difficulty of illustration. Rotary table F is raised and rotated at the same time. The machine operator manually selects the amount of drive energy supplied both to the rotary drive lines U and to the lift drive line S. A theoretically correct ratio for these two drives is established by the pitch of the threads on drill stem section N. The male thread on the lower end of drill stem section N is designated by reference numeral 13 while the female thread on the upper end is designated by reference numberal 14. Both of these threads of course have the same pitch since the male thread of one section is adapted to engage the female thread of the next section, and vice versa. As best shown in FIG. 7 these threads are preferably double lead threads having a relatively steep pitch. The relatively steep pitch of these threads permits the new drill stem section N to be screwed on to the pre-existing drill string H with greater rapidity.

Figure 5:
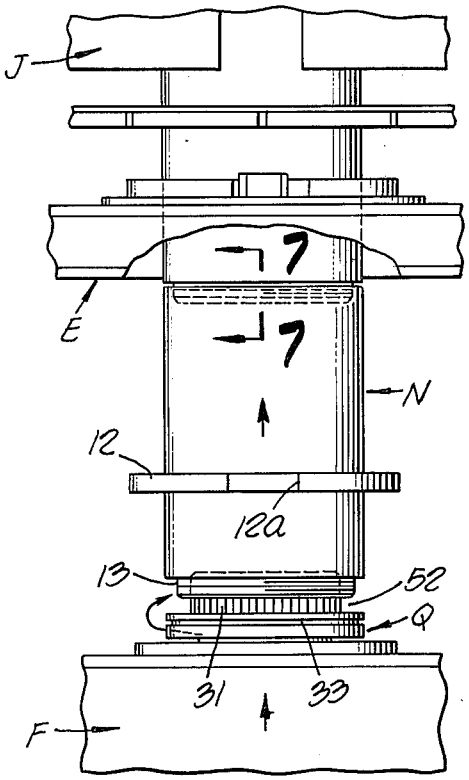
FIG. 5 is a view like FIG. 4, showing the same drill stem section after it has become threadedly secured to the drill string.

As a practical matter it is not possible for the operator to achieve precisely the correct ratios between the rotating and vertical drives for the rotary table F. The preferred method, therefore, is to apply extra power to the rotary drive so that the drill stem section N is rotating faster than necessary. The result of this procedure is shown in FIG. 5. When the female thread 14 of the lowermost drill stem section N engages the male thread 13 on the bottom end of the pre-existing drill string, the excess of rotary drive over vertical drive from the rotary platform F causes the drill string section N to screw up rapidly on the drill string, and at the same time to lift or float vertically relative to the drive coupling ring Q. As shown in the lower portion of FIG. 5, a vertical separation or space 52 therefore comes to exist between the upper end of the drive coupling ring Q and the lower end of the male thread 13 of the drill stem section N.

The nature of the rotary drive motors T1, T2 is such that the tight threaded engagement of drill stem section N with the threads on the bottom end of drill string H does not result in any damage to the motors, but simply results in a pressure rise which can be detected by the operator in any of various ways. The operator then shuts off the hydraulic energy supply. It is not necessary to shut off the vertical drive at the same time, because the gap 52 must be closed, and when a pressure rise resulting from that closure becomes evident, the operator may then shut off the vertical drive energy.

The next step of the process is to open up the jaws of the hairpin assembly so that the drill string H may be maneuvered both vertically and rotationally by the rotary table F. Drilling of the hole B in an upward direction may then be continued.

When the drill string H has moved upward by the length of one drill stem section N, the process of adding a new section is repeated in the same manner as before.

RETRACTING THE DRILL STRING

The procedure for retracting the drill string is essentially the inverse of the procedure for extending it, with some exceptions, however.

In detaching the lowermost drill stem section there is no ambiguity as to which threaded joint is to be broken by the rotation of the rotary platform F, because there is only one threaded joint. In this regard the present invention differs significantly from the prior art. In prior art machines the lowermost section of drill stem was threadedly connected both to the drill stem and to the rotary table, and hence the rotary movement of the rotary table in unwinding the lowermost drill stem section might result in breaking the upper joint, or the lower joint. Special precautions had to be taken to achieve the kind of action that was desired.

According to the present invention, when detaching the lowermost drill stem section, the hairpin assembly is used to lock the position of the drill string. Then the rotary table is lowered and also rotated in an unwinding direction, with the vertical drive being powered somewhat more than the rotary drive. A gap 52 may again appear, and this does not diminish the effectiveness of the rotary drive because the longitudinal interengagement of the splines is approximately 1½ inches. When the table has been lowered far enough to disengage the threads, the downward movement of the table may be stopped until the thread in fact becomes fully disengaged.

It is also preferred to utilize the positioner O, in essentially the inverse of previous procedure, in order to avoid hand labor and lost time in removing the drill stem section N.

HAIRPIN ASSEMBLY

The collar 12 of drill stem section N is not a continuous circular flange extending about the pipe section, but has four recesses **12*a*, 12*b*, 12*c*, 12*d* formed therein. The jaws 20, 21, provide vertical support for the drill string H by moving underneath the collar 12, as best shown in FIG. 11. The rotational position of the drill string must be such that lug 20*a* carried by jaw 20 will enter one of the recesses 12*a* . . . 12*b* while lug 21*a* carried by jaw 21** will enter the opposite recess. The drill string is therefore supported vertically and at the same time is locked rotationally.

Each of the turnbuckle shafts 24, 25 is threaded on both of its ends, but the direction of the thread on one end is opposite relative to the direction of the thread on the other end. The pinion gear rigidly fastened to the longitudinal center of each shaft separates the left hand thread from the right hand thread. The threaded openings in the associated ends of the jaws 20, 21, are similarly threaded in relatively reversed directions. Therefore, rotation of one of the turnbuckle shafts in one direction has the effect of drawing both jaws towards each other, while rotation in the opposite direction has the effect of opening the jaws. The drive chains 28, 29, are synchronized in such a way that both turnbuckle shafts produce opening action at the same time, or else they both produce a closing action at the same time.

One advantage of the hairpin mechanism is its compactness. As shown in FIG. 10 it is possible to open the jaws so that they extend laterally beyond the frame portions, track means, and turnbuckle shafts. But yet the threaded engagement of each jaw end with the associated turnbuckle shaft is effective for drawing the jaw back in towards the center of the machine, when desired.

CLAMP ASSEMBLY

Clamp assembly V and its method of operation are illustrated in drawing FIGS. 15 through 18, inclusive. The clamp includes two semi-circular portions 60, 70. The half ring 60 has a hinge portion 61 on its exterior wall surface at one end of the half ring, and it has a pair of hinge portions 62 on its exterior wall surface at its other end. The half ring 70 has a pair of hinge portions 71 which cooperate with the hing portion 61, as well as a single hinge portion 72 which cooperates with hinge portions 62.

A hinge pin 75 permanently fastens the hinge portion 61, 71, together, so that the two half rings may swing to a closed position (as shown in FIG. 18) or to an open position as shown in dotted lines in FIG. 16. When the two half rings are closed the hinge portions 62 and 72 have aligned openings into which a fastening pin 76 (with a ring on its upper end as a handle) may be inserted.

Clamp assembly V may alternatively be described as a split nut.

Each half ring 60, 70 has a circular flange 65 formed on the interior wall thereof. When the clamp assembly is closed the flanges 65 occupy groove 33 in the drive coupling ring Q, thereby locking the clamp assembly on the ring. The clamp assembly V is, however, free to rotate relative to the ring Q.

Each half ring also has formed in its upper interior wall a female thread portion 66. When the clamp or nut is closed, the threads 66 engage the male thread 13 on the lower exterior end of drive drill stem section N.

Ordinarily the sheer weight of drill string H will cause it to rest firmly upon the rotary table F; that is, the flat circumferential lower face 15 of the drill stem section N will rest firmly upon the upwardly facing circumferential shoulder 32 of drive coupling ring Q. However, during certain of the drilling operations it is necessary to firmly secure the drill string at its lower end so that it cannot become displaced from the rotary table F. That is the purpose of clamp assembly V.

When the clamp assembly is initially closed its female threads 66 will not necessarily be aligned with the male threads 13 of the drill stem section N. Half ring 60 has a block 63 welded on its outer surface, and half ring 70 has a block 73 welded on its outer surface. These blocks are hammered upon in order to rotate the clamp assembly in one direction or the other, as desired. The operator can conveniently determine the projected misalignment of the threads, hammer upon the blocks 63, 73 to rotate the ring by the desired amount, and then close the two halves together. The fastening pin 76 is then inserted in the hinge portions 62, 72.

Even though the nut is aligned and in place, the drill stem may not be locked as tightly to the coupling ring Q as is possible. Therefore, the blocks 63, 73 may be hammered an additional amount so as to securely tighten the threads and thereby securely lock the drill stem section in place.

REPLACEMENT OF DRIVE RING

Drive coupling ring Q is secured to the spindle R by means of a keeper ring 80. Keeper ring 80 is fastened to the upper end of spindle R by means of screws 81.

Due to repeated engagement and disengagement of the spline 31 of drive coupling ring Q with the mating spline connection of a drill stem section, there is a potential for considerable wear. It is therefore desirable to be able to replace the ring Q with a new one from time to time. This is done simply by removing the keeper ring 80, removing the drive coupling ring Q, installing a new coupling ring Q, and replacing the keeper ring 80.

ALTERNATE FORMS

According to the preferred form of the invention the drill stem section N has female thread 14 at its upper end, male thread 13 at its lower end, and spline connection 10 formed in the interior wall surface of its lower end. Other arrangements of the drill stem section are possible, however, and are effective for carrying out the purposes of the present invention.

Figure 19:
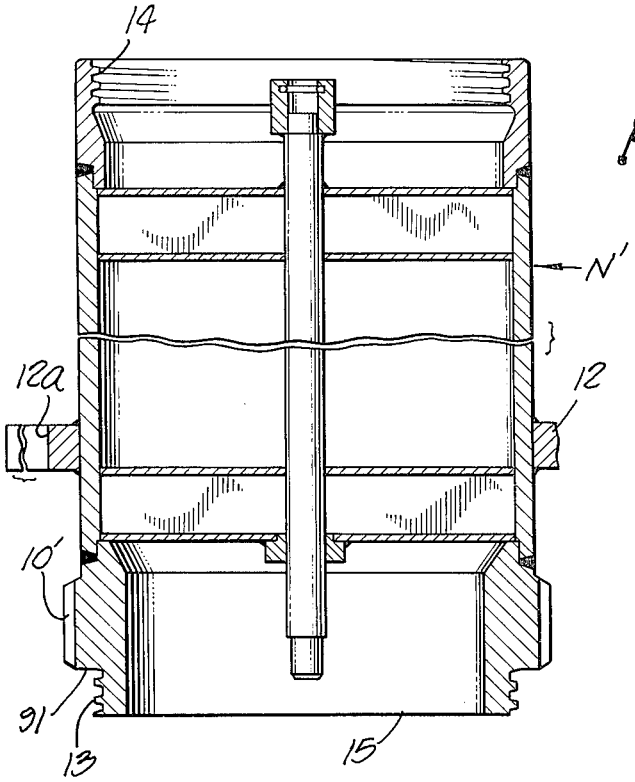
FIG. 19 is a cross-sectional elevational view, partially cut away, of a first alternate form of drill stem section in accordance with the invention.

Thus in FIG. 19 a drill stem section N′ has a female thread portion 14 on its upper end and a male thread 13 on its lower end. A spline connection 10′, however, is also formed on the lower end, being located above the male thread 13 and separated therefrom by a circumferential shoulder 91. When the external spline connection is on the drill stem section as shown in FIG. 19, it becomes necessary to modify the drive coupling ring Q by placing its spline connection on the interior wall, as the female portion of the coupling. While this construction is not specifically shown it will be readily understood by those skilled in the art.

Figure 20:
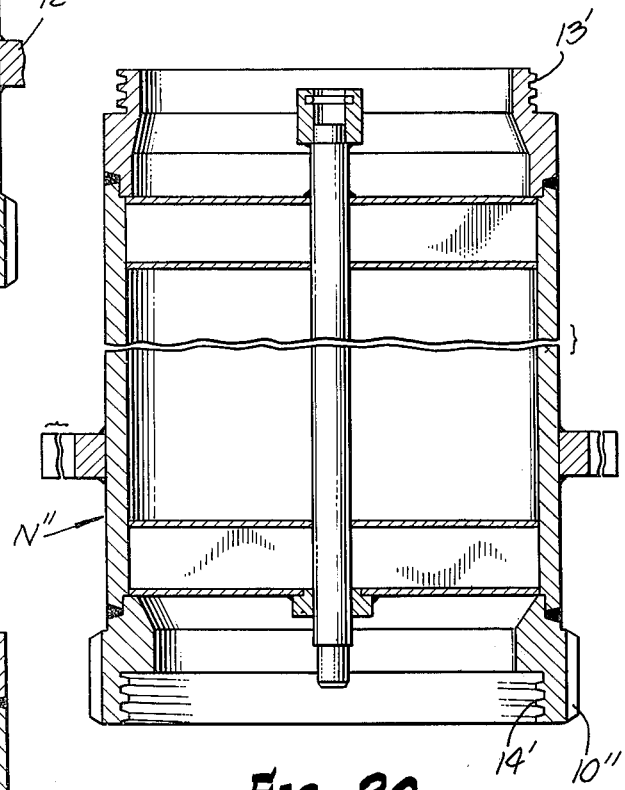
FIG. 20 is a view like FIG. 19 but showing a second alternate form of drill stem section in accordance with the invention.

In FIG. 20 a drill stem section N″ has a male thread 13′ on its upper end and a female thread 14′ on its lower end. A spline connection 10″ is on the exterior surface of the lower end of the pipe section. Here again a modified form of the drive coupling ring Q is required, but because of the absence of the circumferential shoulder 91, and the spline connection 10′ extending all the way to the lowermost end of drill stem section N″, the form of the drive coupling ring is somewhat different from that required for the embodiment of FIG. 19.

Figure 21:
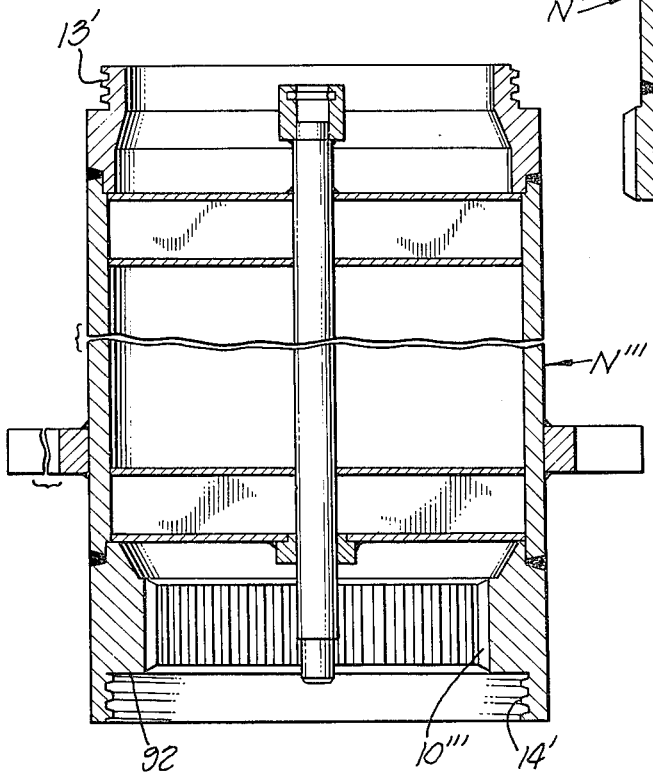
FIG. 21 is a view like FIG. 19 but showing a third alternate form of drill stem section in accordance with the invention.

FIG. 21 shows a drill stem section N‴. This pipe section has a male thread 13′ on its upper end and a female thread 14′ on its lower end. An interior or female spline connection 10‴ is located above the thread 14′, being separated therefrom by a circumferential shoulder 92. Here again it is necessary to modify the drive coupling ring Q in an appropriate manner.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A vertical thrust boring machine comprising:

a drill string including a series of threadedly connected drill stem sections, the lowermost section having a spline connection on its lower end;

a rotary table above which said drill string extends in an upwardly direction;

a drive coupling ring attached to said rotary table to move therewith, said drive coupling ring having a spline connection adapted to matingly engage the spline connection of said lowermost drill stem section;

power driven means for selectively rotating said table;

power driven means for selectively raising or lowering said table;

holding means selectively operable for grasping the drill string above the elevation of said lowermost drill stem section, so as to fix the vertical position of the string while said lowermost section is being attached or detached; and a clamp assembly encircling and rotatably supported from said drive coupling ring, said clamp assembly including means for selectively threadedly engaging a male thread formed on the lower end of said lowermost drill stem section.

2. In a vertical thrust boring machine, a rotary table assembly comprising:

a rotary table;

power drive means for selectively rotating said rotary table;

power drive means for selectively raising or lowering said rotary table;

separate control means for independently controlling the operation of each of said power drive means;

a drive coupling ring removably attached to the upper surface of said rotary table; and said drive coupling ring having a splined drive connection formed in the exterior circumferential surface thereof.

3. In a vertical thrust boring machine, a rotary table assembly comprising:

a rotary table;

power drive means for selectively rotating said rotary table;

power drive means for selectively raising or lowering said rotary table;

separate control means for independently controlling the operation of each of said power drive means;

a drive coupling ring removably attached to the upper surface of said rotary table; and said drive coupling ring having a splined drive connection formed in one circumferential surface thereof;

the upper end of said spline drive connection being chamfered to facilitate engagement with a mating spline drive connection formed on a drill stem section superimposed above said drive coupling ring.

4. The method of handling a drill stem section for purpose of incorporating it into a continuous drill string, comprising the steps of:

forming male and female threads on respective ends of the drill stem section, and additionally forming a spline connection on the rearward end thereof;

threadedly engaging the forward end of the drill stem section with the rearward end of a previously formed drill string portion, by utilizing the spline connection on its rearward end for rotary drive thereof, and utilizing an end face on its rearward end for forward drive, but not utilizing the threaded connection on its rearward end; and when attaching the next succeeding drill stem section to the rearward end thereof, using the threaded connection but not the spline connection for that purpose.

5. In a boring machine for drilling upwardly, the combination comprising:

a drill stem section that is to be added to the lower end of a previously formed drill string, said drill stem section having a male thread formed on one of its ends and a female thread formed on the other of its ends, and also having a spline connection formed on its lower end;

a rotary table assembly having vertical support means thereon adapted to engage a lower end face of said drill stem section for providing vertical support thereof, said rotary table assembly also including keying means engageable with said spline connection of said drill stem section for rotatably driving the same, said keying means also being longitudinally slidable relative to said spline connection; and power drive means associated with said rotary table assembly and selectively operable for raising and concurrently rotating said rotary table assembly;

the operation being characterized by the fact that driving torque is applied to said drill stem section only through said spline connection thereof, and being further characterized by the fact that when the upper end of said drill stem section threadedly engages the lower end of the previously formed drill string, said drill stem section is then free to slide upwardly relative to said keying means, said drill stem section together with said spline connection thereof then becoming part of the drill string.

6. The method of attaching a threaded drill stem section to the lower end of an upwardly extending drill string, comprising the steps of:

forming a spline connection on the lower end of the drill stem section;

placing the drill stem section beneath the drill string with its upper end spaced therefrom;

placing a raisable platform beneath a lower end face of the drill stem section;

circumferentially engaging the spline connection of the drill stem section with a mating rotary drive means which is longitudinally slidable thereon;

lifting the platform and rotary drive means so as to lift the drill stem section; and concurrently rotatably driving the drill stem section by applying driving torque thereto solely through said rotary drive means, at a rotary drive rate which is sufficiently high relative to the lifting rate so that when the upper end of the drill stem section threadedly engages the lower end of the drill string the section will be pulled upward relative to the platform and rotary drive means;

whereby the drill stem section including said spline connection thereof then becomes part of the drill string.

* * * * *